US005455659A

United States Patent [19]

Ishizu et al.

[11] Patent Number: 5,455,659

[45] Date of Patent: Oct. 3, 1995

[54] APPARATUS WITH DETECTOR FOR DETECTING OBJECT TO BE DETECTED

[75] Inventors: Masanori Ishizu; Hiroshi Hashimoto; Soya Endo, all of Tokyo; Hitoshi Machino, Kawasaki; Tomohiro Nakamori, Ichikawa, all of Japan

[73] Assignee: Canon Kabushiki Kaisha, Tokyo, Japan

[21] Appl. No.: 347,177

[22] Filed: Nov. 22, 1994

Related U.S. Application Data

[63] Continuation of Ser. No. 70,878, Jun. 3, 1993, abandoned.

[30] Foreign Application Priority Data

| | | | |
|---|---|---|---|
| Jun. 10, 1992 | [JP] | Japan | 4-150732 |
| Jun. 10, 1992 | [JP] | Japan | 4-150734 |
| May 27, 1993 | [JP] | Japan | 5-126168 |

[51] Int. Cl.[6] ..... G03G 21/00

[52] U.S. Cl. ..... 355/209; 271/3.13; 355/308

[58] Field of Search ..... 355/203, 204, 355/205, 206, 207, 208, 209, 316, 317, 308, 309; 271/259, 264, 265, 258, 259, 227, 229, 3.1

[56] References Cited

U.S. PATENT DOCUMENTS

| | | | |
|---|---|---|---|
| 4,255,651 | 3/1981 | Phillips | 235/925 B |
| 4,540,170 | 9/1985 | Masuda et al. | 271/259 |
| 4,549,805 | 10/1985 | Iimori | 355/309 |
| 4,608,704 | 8/1986 | Sherman, III et al. | 271/4 X |
| 4,707,599 | 11/1987 | Sherman, III et al. | 250/223 R |
| 4,789,903 | 12/1988 | Kamada et al. | 358/296 |
| 5,018,716 | 5/1991 | Yoshida et al. | 271/227 |
| 5,250,813 | 10/1993 | Takahashi et al. | 250/561 |
| 5,253,856 | 10/1993 | Fuchi et al. | 271/9 |
| 5,321,486 | 6/1994 | Nambu et al. | 355/311 |

*Primary Examiner*—A. T. Grimley
*Assistant Examiner*—Thu A. Dang
*Attorney, Agent, or Firm*—Fitzpatrick, Cella, Harper & Scinto

[57] ABSTRACT

An image recording apparatus for printing an image on a conveyed recording medium, includes a sensor, arranged on a convey path of the recording medium, for detecting presence/absence of the recording medium, a setting unit for setting a debouncing time of the recording medium, and a switching unit for switching the debouncing time.

16 Claims, 18 Drawing Sheets

| SWITCH | | | PAPER SIZE |
|---|---|---|---|
| 41 | 42 | 43 | |
| × | × | × | NONE |
| × | × | ○ | A4 |
| × | ○ | × | A5 |
| × | ○ | ○ | A6 |
| ○ | × | × | B4 |
| ○ | × | ○ | B5 |
| ○ | ○ | × | B6 |
| ○ | ○ | ○ | A3 |

○-----ON
×-----OFF

APPARATUS WITH DETECTOR FOR DETECTING OBJECT TO BE DETECTED

This application is a continuation of application Ser. No. 08/070,878, filed Jun. 3, 1993, now abandoned.

BACKGROUND OF THE INVENTION

1. Field of the Invention

The present invention relates to an apparatus with a detector for detecting an object to be detected such as a recording medium and, more particularly, to an image recording apparatus provided with a paper presence/absence detecting sensor for monitoring a conveying condition of paper on a paper conveying path.

2. Related Background Art

A signal output from a paper presence/absence detecting sensor provided to a paper conveying path in an image recording apparatus is not received for a predetermined debouncing time to prevent chattering due to noise upon operation of the sensor, and when a signal from the sensor continues beyond the debouncing time, paper presence/absence information is determined.

In such an image recording apparatus, a paper size is detected by a sensor provided to, e.g., a feed paper cassette, and registration rollers are driven for a time corresponding to the detected paper size.

However, in the above-mentioned apparatus, the predetermined debouncing time is always set to detect the presence/absence of paper. On the other hand, a common sensor is often used for both jam detection and paper size detection. When the debouncing time is shortened, chattering cannot be prevented, and the sensor may make erroneous detection, thus causing troubles such as erroneous operations. Conversely, when the debouncing time is prolonged, jam detection cannot be performed.

Since the registration rollers are driven by a length obtained by the paper size detection, if selected paper is shorter than the paper size obtained by the paper size detection or paper is fed from, e.g., a universal cassette, the registration rollers are driven for a time longer than the actual paper size, thus causing anomalous temperature rise, deterioration of the registration rollers, a decrease in service life of a registration clutch, and the like.

SUMMARY OF THE INVENTION

It is an object of the present invention to provide an apparatus which can prevent erroneous detection according to applications, and can perform reliable detection.

It is another object of the present invention to provide an image recording apparatus which can prevent chattering, and can reliably detect a recording medium.

According to the present invention, since a means for switching a debouncing time of a sensor between a case wherein a sensor output changes and a case wherein the sensor output does not change, and a means for switching the debouncing time between a case wherein the sensor output changes from paper absence information to paper presence information and a case wherein the sensor output changes from paper presence information to paper absence information are arranged, the debouncing time can be set according to applications and functions of the sensor.

According to the present invention, since a means for detecting a state of the image recording apparatus is arranged, the detection time of the sensor is changed in correspondence with the state of the image recording apparatus, thereby preventing erroneous detection of a jam.

As an application of the sensor, the sensor can detect the trailing end of paper to stop the driving operation of registration rollers, thus minimizing the driving time of the registration rollers.

In this case, since an erroneous operation caused by chattering of the sensor upon driving of the registration rollers is prevented, the driving operation of the registration rollers will not be interrupted halfway through.

Such an application method can be applied to, e.g., a feed paper method using a universal cassette.

Other objects, effects, and advantages of the present invention will become apparent from the following detailed description taken in conjunction with the accompanying drawings, and appended claims.

DETAILED DESCRIPTION OF THE PREFERRED EMBODIMENTS

The preferred embodiments of the present invention will be described hereinafter with reference to the accompanying drawings.

(First Embodiment)

Figure 1:
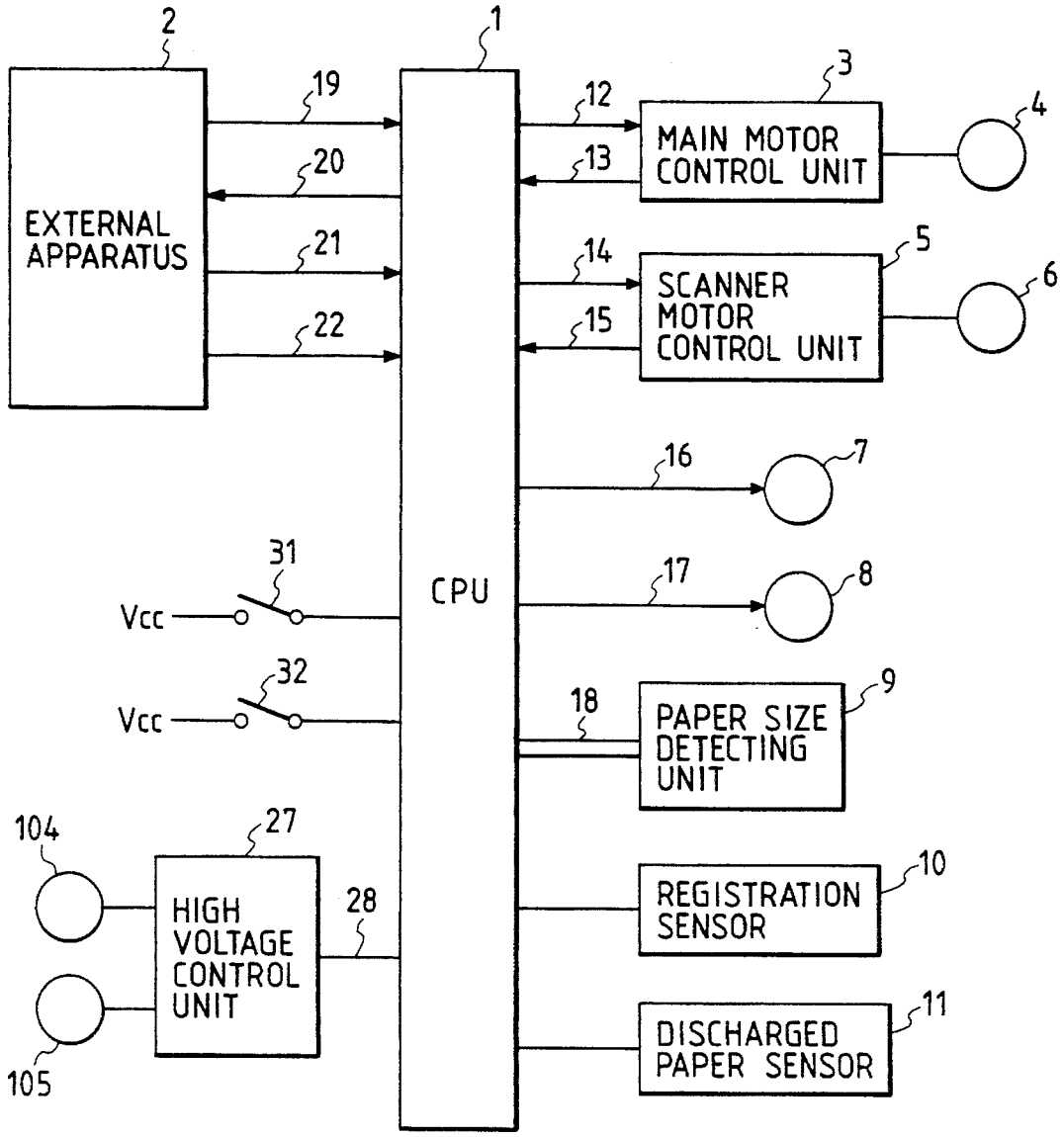
FIG. 1 is a block diagram showing a schematic arrangement of an image recording apparatus to which the present invention is applied.

FIG. 1 is a block diagram best illustrating the feature of the present invention. An image recording apparatus shown in FIG. 1 includes a one-chip microcomputer (CPU) 1 incorporating a ROM, an external apparatus 2 such as a so-called video controller, a host computer, or the like, a main motor control unit 3, a main motor 4, a scanner motor control unit 5, a scanner motor 6, a feed paper roller 7, a registration clutch 8, a paper size detecting unit 9, a registration sensor 10, a discharged paper sensor 11, a motor 0N signal 12, a motor ready signal 13, a scanner ON signal 14, a scanner ready signal 15, a feed paper roller 0N signal 16, a registration clutch ON signal 17, a paper size signal 18, a signal 19 for requesting the start of a print operation (to be referred to as a PRNT signal hereinafter), a signal 20 for requesting a vertical sync signal (to be referred to as a VSREQ signal), a vertical sync signal 21 (to be referred to as a VSYNC signal hereinafter), a video signal 22 (to be referred to as a VDO signal hereinafter), a high voltage control unit 27, a door switch 31, and a power supply switch 32.

Figure 2:
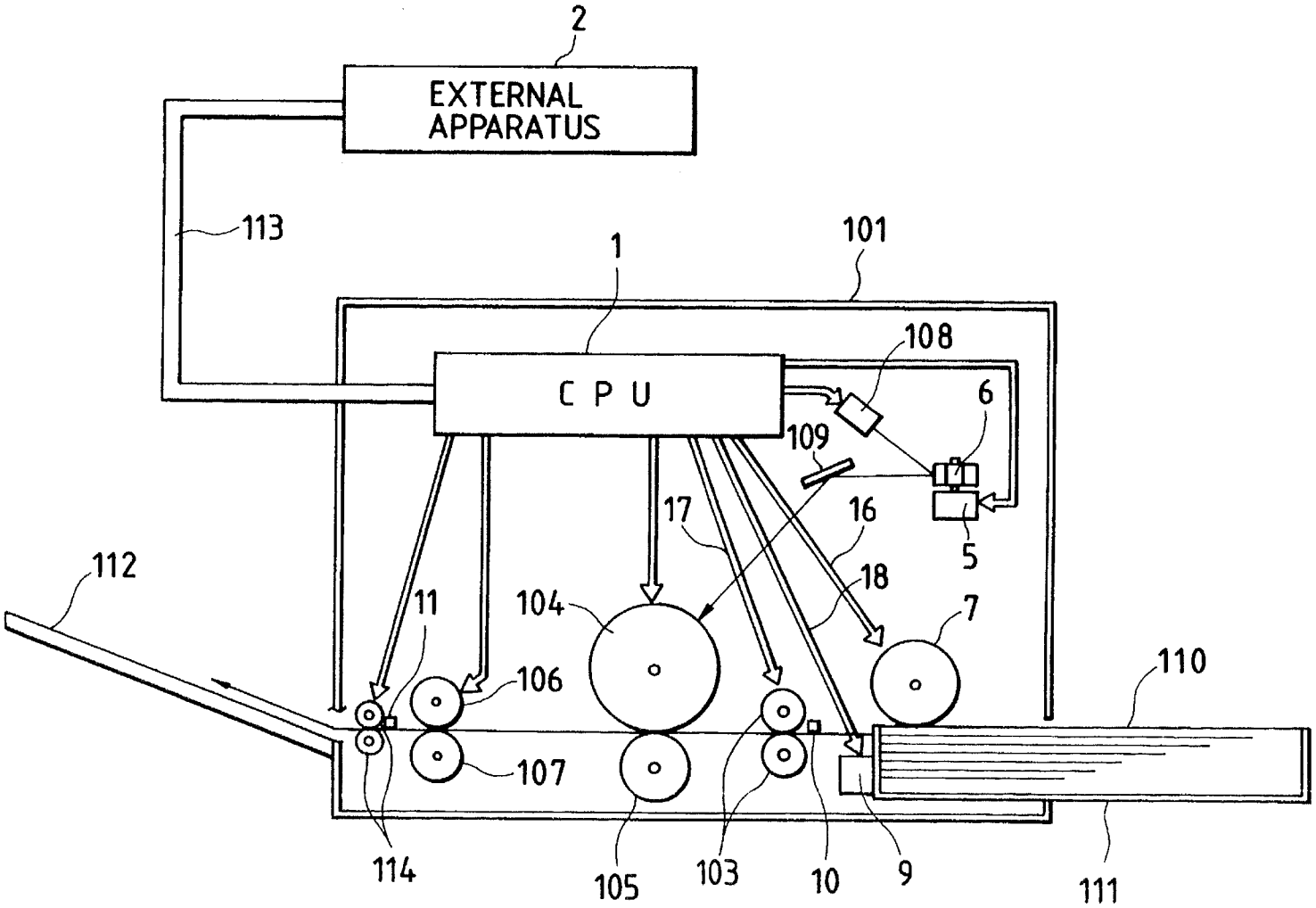
FIG. 2 is a sectional view showing the image recording apparatus to which the present invention is applied.

FIG. 2 is a schematic sectional view of the image recording apparatus adopting this embodiment. The apparatus shown in FIG. 2 includes a housing 101, registration rollers 103, a photosensitive drum 104, a transfer roller 105, a fixing roller 106, a compression roller 107, a laser unit 108, a reflection mirror 109, cut paper sheets 110, a cassette 111, a discharged paper tray 112, an interface cable 113, and paper discharging rollers 114.

The operation of the image recording apparatus will be briefly described below with reference to FIGS. 1 and 2.

Upon reception of the PRNT signal 19 from the external apparatus 2, the CPU 1 sends the motor 0N signal 12 to the main motor control unit 3. Upon reception of this signal, the main motor control unit 3 drives the main motor 4. When the main motor 4 reaches a predetermined rotational speed, the main motor control unit 3 sends back the motor ready signal 13 to the CPU 1.

Thereafter, the CPU 1 sends the scanner ON signal 14 to the scanner motor control unit 5, and the scanner motor control unit 5 drives the scanner motor 6. When the scanner motor 6 reaches a predetermined rotational speed, the scanner motor control unit 5 sends back the scanner ready signal 15 to the CPU 1. The CPU 1 drives the feed paper roller 7 to convey a cut paper sheet 110 in the cassette 111 to the position of the registration rollers 103.

Thereafter, the CPU 1 sends the VSREQ signal 20 to the external apparatus 2, and waits for the VSYNC signal 21 from the external apparatus 2. Upon reception of the VSYNC signal 21, the CPU 1 turns on the registration clutch ON signal to turn on the registration clutch 8. When the registration clutch 8 is turned on, the registration rollers 103 connected to the clutch 8 are driven.

The VDO signal (not shown) from the external apparatus 2 is supplied to the laser unit 108 to emit a laser beam. The laser beam emitted from the laser unit 108 is radiated on the photosensitive drum 104 by the scanner motor 6 and the reflection mirror 109. Then, an image is transferred on the cut paper sheet 110 conveyed by the registration rollers 103 by the photosensitive drum 104 and the transfer roller 105.

Thereafter, the image transferred on the cut paper sheet 110 is fixed by the fixing roller 106 and the compression roller 107, and the cut paper sheet 110 is discharged onto the discharged paper tray 112 by the paper discharging rollers 114.

The registration sensor 10 and the discharged paper sensor 11 monitor the conveying state of each cut paper sheet 110. When a cut paper sheet 110 is present at the position of each sensor, the corresponding sensor is turned on; otherwise, it is turned off. Such information is read by the CPU 1.

The CPU 1 also reads a paper size of a selected cut paper sheet from the paper size detecting unit 9 attached adjacent to the cassette 111.

Figures 3, 4:
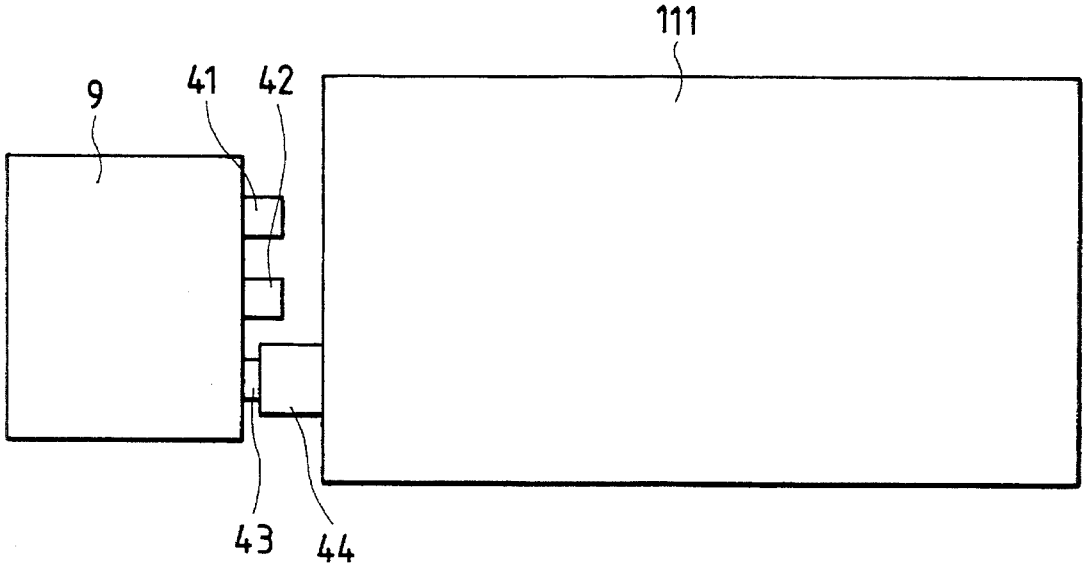
FIG. 3 is a view for explaining paper size detection according to the first embodiment of the present invention.
FIG. 4 is a table showing the relationship between the states of switches 41 to 43 and paper sizes in the first embodiment.

FIG. 3 shows the details of the paper size detecting unit. The paper size of a selected cut paper sheet can be detected by turning on/off switches 41, 42, and 43 attached on the paper size detecting unit 9 by a projection 44 attached to the cassette 111.

Various paper sizes can be set by changing the position of the projection 44 or using a plurality of projections. FIG. 4 shows the relationship between the ON/OFF states of the switches 41, 42, and 43, and paper sizes determined by these states. In FIG. 3, since the switch 43 is turned on, and the switches 41 and 42 are turned off, the paper size is A4.

Figure 5:
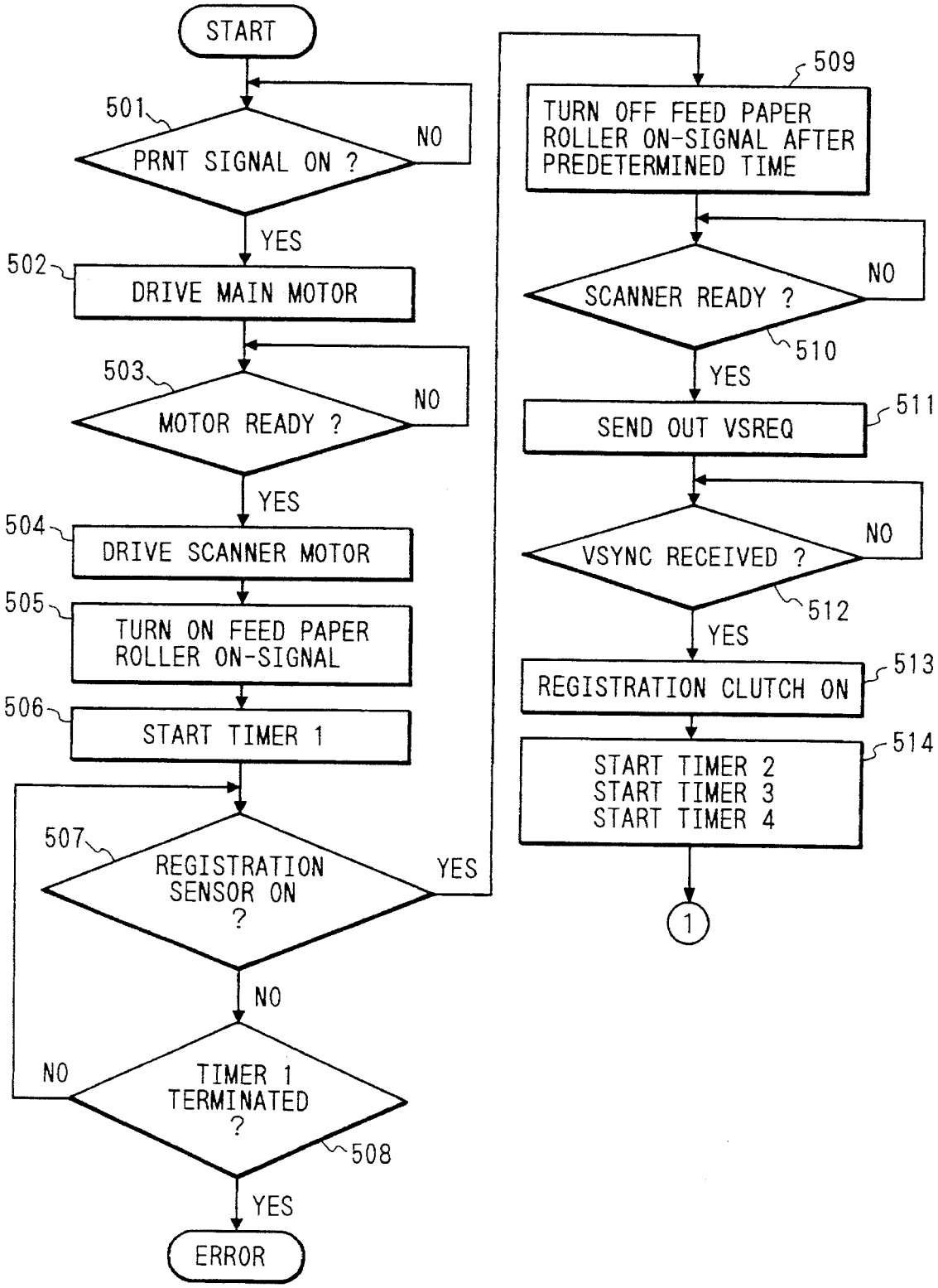
FIG. 5 is a flow chart for explaining an operation of the first embodiment.

This embodiment will be described in detail below with reference to the flow charts shown in FIGS. 5 and 6. Timer #1 to timer #6 are down counters. In step 501, the CPU 1 monitors the PRNT signal 19 transmitted from the external apparatus 2. Upon reception of the PRNT signal 19, the CPU 1 drives the main motor 4 in step 502. In step 503, the CPU 1 monitors if the motor is ready. If it is determined in step 503 that the motor is ready, the CPU 1 drives the scanner motor in step 504.

In step 505, the feed paper roller ON signal is turned on. In step 506, the timer #1 is started. The timer #1 is set with a value obtained by adding a predetermined margin to a value obtained by dividing the distance from the leading end of the cut paper sheet 110 to the registration sensor by the conveying speed of the feed paper roller 7, and is used for feed paper delay jam detection.

In step 507, the CPU 1 monitors if the registration sensor is turned on. If the registration sensor is OFF, the CPU 1 monitors in step 508 if the timer #1 is terminated. If the registration sensor is not turned on after the timer #1 is terminated, a jam is determined, and this subroutine ends as an error.

If the registration sensor is turned on, after an elapse of a sum of a time corresponding to a value obtained by dividing the distance from the registration sensor to the registration rollers by the convey speed of the feed paper roller and a time required for forming a predetermined loop amount, the feed paper roller ON signal 16 is turned off in step 509, thus completing the feed paper operation.

Thereafter, the CPU 1 monitors in step 510 if the scanner is ready. If the scanner is ready, the CPU 1 sends the VSREQ signal 20 to the external apparatus 2 in step 511. In step S512, the CPU 1 waits for the VSYNC signal 21 sent back from the external apparatus 2. When the CPU 1 receives the VSYNC signal 21, the CPU 1 drives the registration clutch 8 in step 513.

In step 514, the CPU 1 starts the timers #2, #3, and #4.

The timer #2 is used for preventing the following phenomenon. That is, the cut paper sheet 110, the leading end of which is caught by the registration rollers to form a loop, is pulled when the registration rollers are turned on. At this time, the registration sensor causes chattering and is turned off to erroneously detect a paper absence state although a cut paper sheet is actually present at the registration sensor position.

The timer #2 is set with a value obtained by subtracting a predetermined margin from a value obtained by dividing a minimum size that can be conveyed by this image recording apparatus by the process speed (e.g., A6 (148.5 mm)/12π–0.94 sec=3 sec).

The value of the timer #3 corresponds to a time required until the cut paper sheet passes the registration sensor, and is set to be a value obtained by adding a predetermined margin to a value obtained by dividing the paper size—(the distance from the registration sensor 10 to the registration rollers 103) by the process speed. The timer #3 is used for retention jam detection at the registration sensor position.

The value of the timer #4 corresponds to a time required until the cut paper sheet reaches the discharged paper sensor, and is set to be a value obtained by adding a predetermined margin to a value obtained by dividing the distance from the registration rollers 103 to the discharged paper sensor 11 by the process speed. The timer #4 is used for paper discharging delay jam detection.

Figure 6:
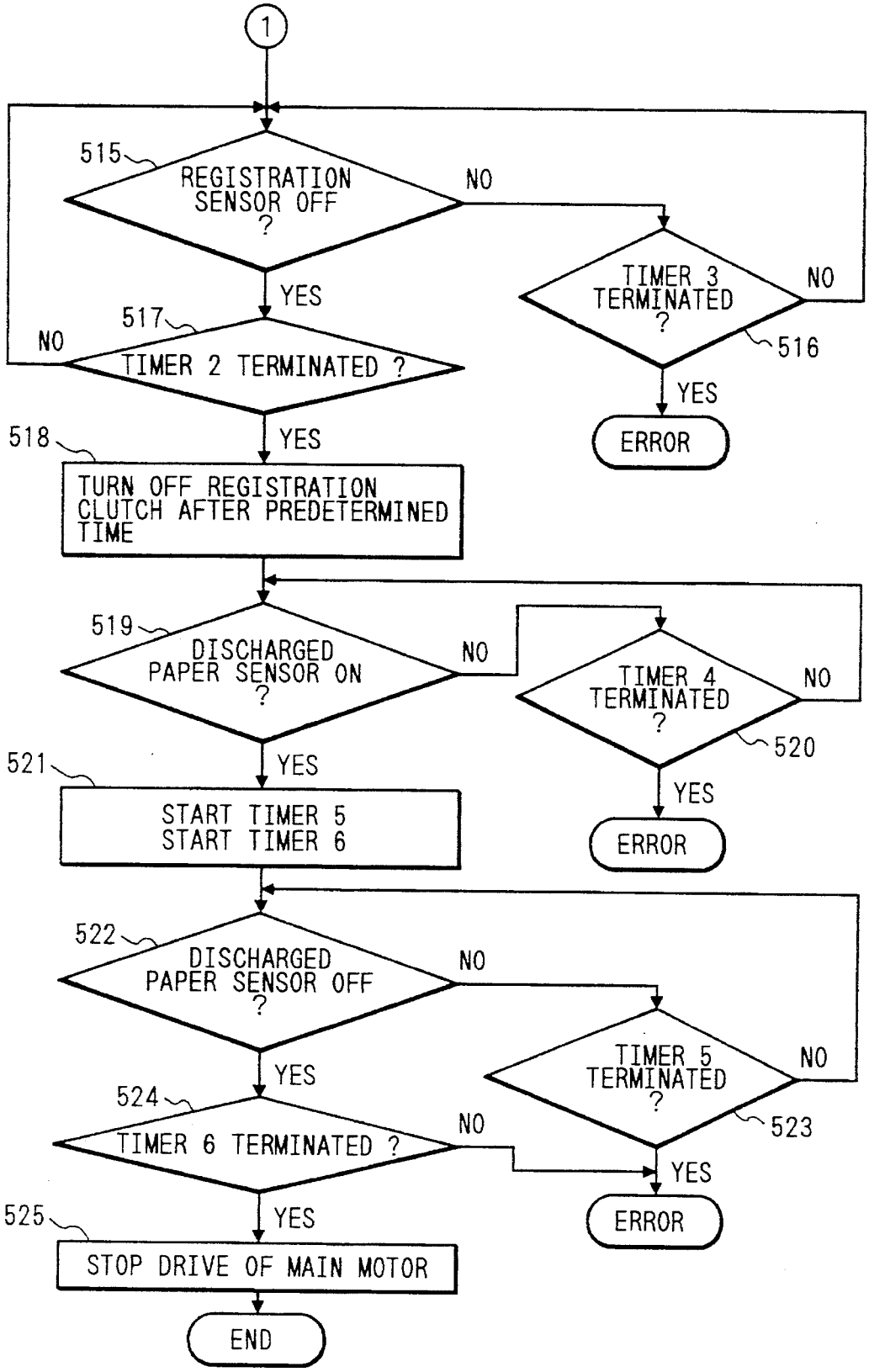
FIG. 6 is a flow chart for explaining the operation of the first embodiment.

Referring to FIG. 6, in step 515, the CPU 1 monitors if the registration sensor is turned off. If the registration sensor is ON, the CPU 1 monitors in step 516 if the timer #3 is terminated. If the registration sensor 10 is ON even after the timer #3 is terminated, a registration retention jam is determined, and the subroutine ends as an error.

If the registration sensor 10 is turned off, the CPU 1 monitors in step 517 if the timer #2 is terminated. If the timer #2 is not terminated, the flow returns to step 515 to repetitively execute the above-mentioned processes.

If the timer #2 is terminated, the CPU 1 waits for an elapse of time required until the trailing end of the cut paper sheet 110 passes the registration rollers 103 from the position of the registration sensor 10, and then turns off the registration clutch 8 in step 518, thus stopping the drive operation of the registration rollers 103.

In step 519, the CPU 1 monitors if the discharged paper sensor 11 is turned on. If the discharged paper sensor 11 is OFF, the CPU 1 monitors in step 520 if the timer #4 is terminated. If the discharged paper sensor 11 is OFF even after the timer #4 is terminated, paper discharging delay jam is determined, and this subroutine ends as an error.

If the discharged paper sensor 11 is turned on, the timers #5 and #6 are started in step 521.

The value of the timer #5 corresponds to a time required until the cut paper sheet 110 passes the position of the discharged paper sensor 11, and is set to be a value obtained by adding a predetermined margin to a value obtained by dividing the paper size by the process speed. The timer #5 is used for paper discharging section retention jam detection.

The timer #6 is used for preventing the cut paper sheet 110 from being wound around the compression roller 107 or the fixing roller 106 after it reaches the discharged paper sensor 11, and is set with a value obtained by dividing the paper size—a predetermined length (e.g., 3 cm) by the process speed.

In step 522, the CPU 1 monitors if the discharged paper sensor is turned off. If the discharged paper sensor is ON, the CPU 1 monitors in step 523 if the timer #5 is terminated. If the discharged paper sensor 11 is not turned off even after the timer #5 is terminated, a paper discharging section retention jam is determined, and this subroutine ends as an error.

If the discharged paper sensor 11 is turned off, the CPU 1 monitors the timer #6 in step 524. If the timer #6 is not terminated, a fixing roller winding jam is determined, and this subroutine ends as an error. If the timer #6 is terminated, the drive operation of the main motor is stopped in step 525.

(Second Embodiment)

In the first embodiment, the value of the timer #2 is calculated from the minimum-size cut paper sheet. However, in the second embodiment, the value of the timer #2 is set to be a time required until the cut paper sheet 110 forms a predetermined loop at the position of the registration rollers 103, the loop at the position of the registration rollers 103 is gradually decreased after the registration rollers are driven, and thereafter, the loop disappears not to influence the registration sensor 10.

Figure 7A:
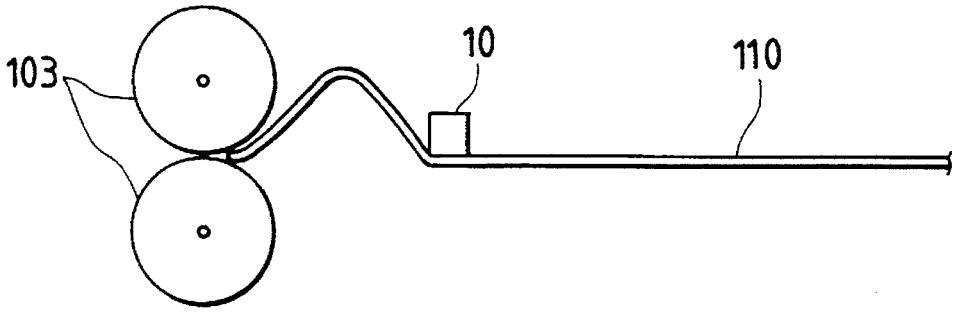
FIGS. 7A to 7C are side views showing loop amounts of cut paper sheets at a registration roller position so as to explain an operation of the second embodiment.
Figure 7B:
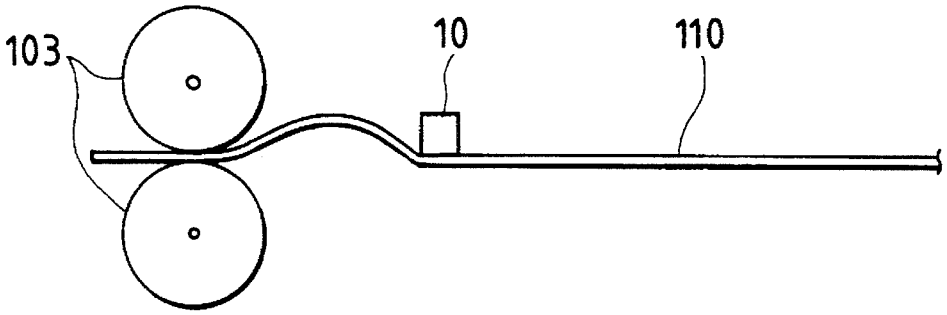
Figure 7C:
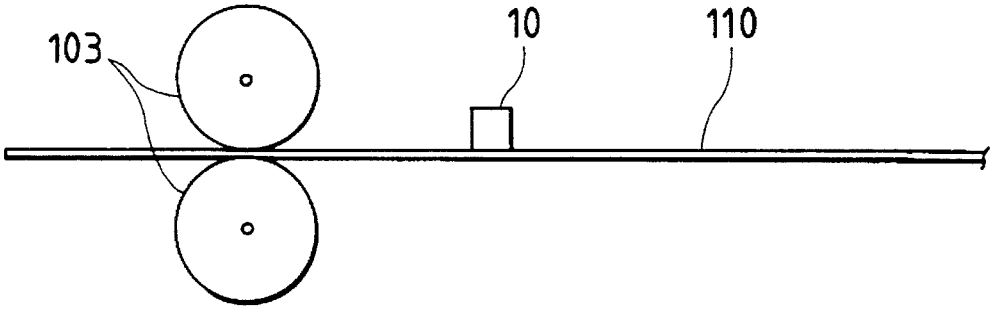

FIG. 7A shows a state wherein a loop is formed at the position of the registration rollers 103, and waits for the drive operation of the registration rollers 103, FIG. 7B shows a state wherein the registration rollers 103 are driven, and the loop is decreased, and FIG. 7C shows a state wherein the loop has completely disappeared.

For example, if the loop amount is 8 mm, the timer 2 is set with a value (about 0.5 sec) obtained by adding a predetermined margin (e.g., 0.3 sec) to a value obtained by dividing the loop amount by the process speed (e.g., 37.7 mm/sec). Other operations and apparatus arrangement are the same as those in the first embodiment, and a detailed description thereof will be omitted.

(Third Embodiment)

In the first and second embodiments, during a predetermined period of time in which the timer #2 is being driven, even if the registration sensor 10 detects a paper absence state, the drive operation of the registration rollers 103 is not stopped. However, in the third embodiment, the registration sensor 10 does not perform paper presence/absence detection during the predetermined period of time in which the timer #2 is being driven.

Figure 8:
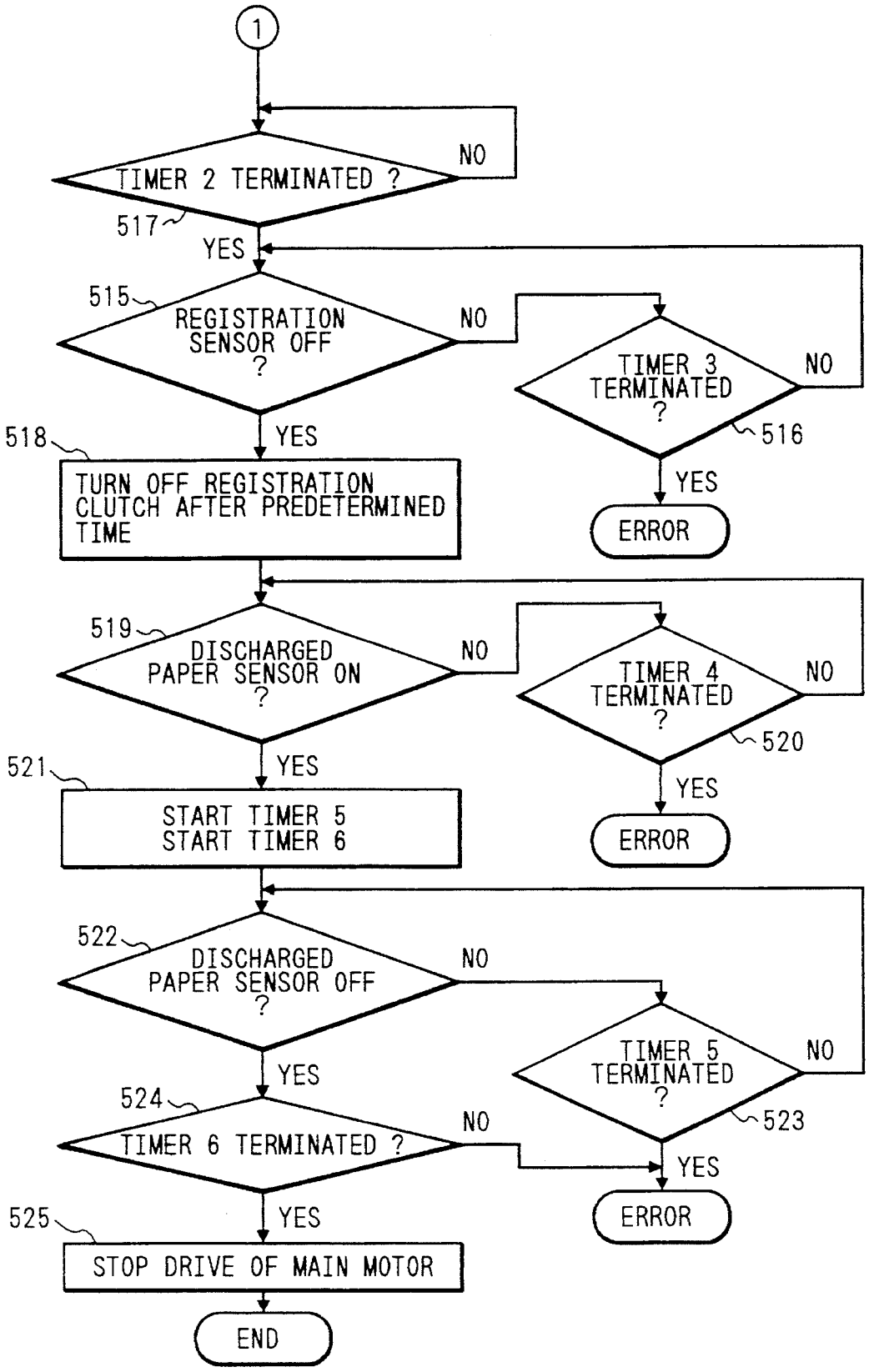
FIG. 8 is a flow chart for explaining an operation of the third embodiment.

FIG. 8 is a flow chart showing the operation of the third embodiment. Since the same operation as that shown in FIG. 5 is executed in the third embodiment, FIG. 8 shows steps after FIG. 5.

In the third embodiment, the operation in step 517 in FIG. 6 is executed before step 515. In step 513, the registration clutch 8 is turned on to drive the registration rollers 103, and in step 514, the timers #2, #3, and #4 are started.

In step 517, the CPU waits for termination of the timer #2, and the flow then advances to step 515.

Other operations and apparatus arrangement are the same as those in the first and second embodiments, and a detailed description thereof will be omitted.

As described above, in the first to third embodiments, the drive operation of the registration rollers is stopped by detecting the trailing end of paper using the registration sensor. Thus, even when the paper size cannot be determined like in a case wherein paper is fed from the universal cassette, the drive time of the registration rollers can be minimized, and durability of the registration rollers 3 can be improved.

Since an erroneous operation caused by chattering of the registration sensor upon driving of the registration rollers is prevented, the drive operation of the registration rollers will not be interrupted halfway through to cause a paper jam.

(Fourth Embodiment)

The fourth to tenth embodiments are suitably applied to the apparatuses of the first to third embodiments, but may also be applied even when the timer #2 is not arranged. Therefore, only the characteristic features of the fourth to tenth embodiments will be described hereinafter.

Figure 9A:
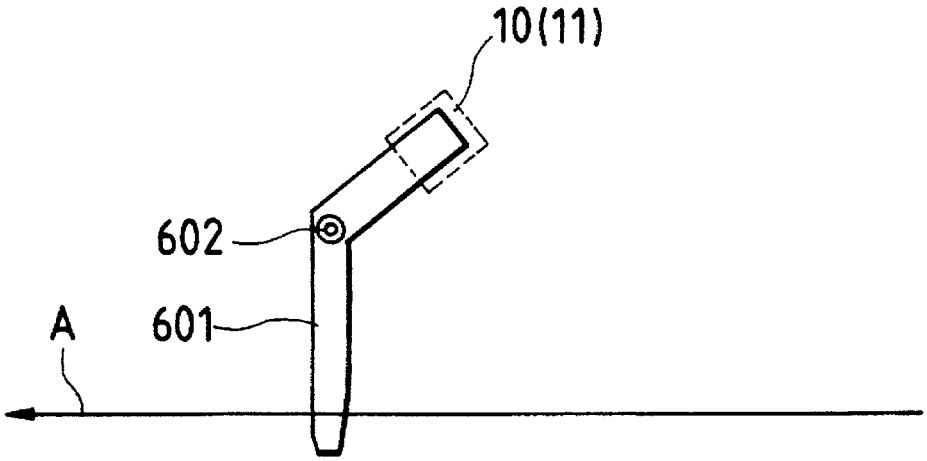
FIGS. 9A and 9B are views showing schematic arrangements of a sensor.
Figure 9B:
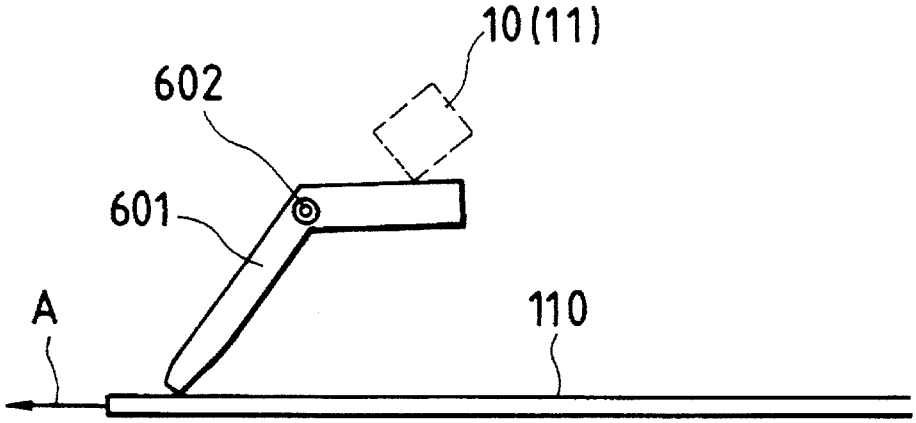

FIGS. 9A and 9B show the details of the registration sensor 10 (and the discharged paper sensor 11), and these sensors will be described in detail below.

In FIGS. 9A and 9B, a registration sensor lever 601 is swingably supported by a shaft 602, and is attached along a paper convey path indicated by an arrow A in FIG. 9A. When no paper is present on the convey path, as shown in FIG. 9A, the leading end (lower end in FIG. 9A) of the registration sensor lever is located at a position crossing the convey path. On the other hand, the trailing end of the registration sensor lever 601 is formed to serve as a light-shielding plate for the registration sensor 10.

When the trailing end of the registration sensor lever 601 is located at a light-shielding position, a High-level signal (a signal of +5 V when the power supply voltage is +5 V) as a cut paper absence signal is output.

When a cut paper sheet 110 is present on the paper convey path, as shown in FIG. 9B, i.e., when the trailing end of the registration sensor lever 601 is located at a non-light-shielding position, a Low-level signal as a cut paper presence signal is output.

The above description applies to the discharged paper sensor, and a detailed description thereof will be omitted.

Figure 19:
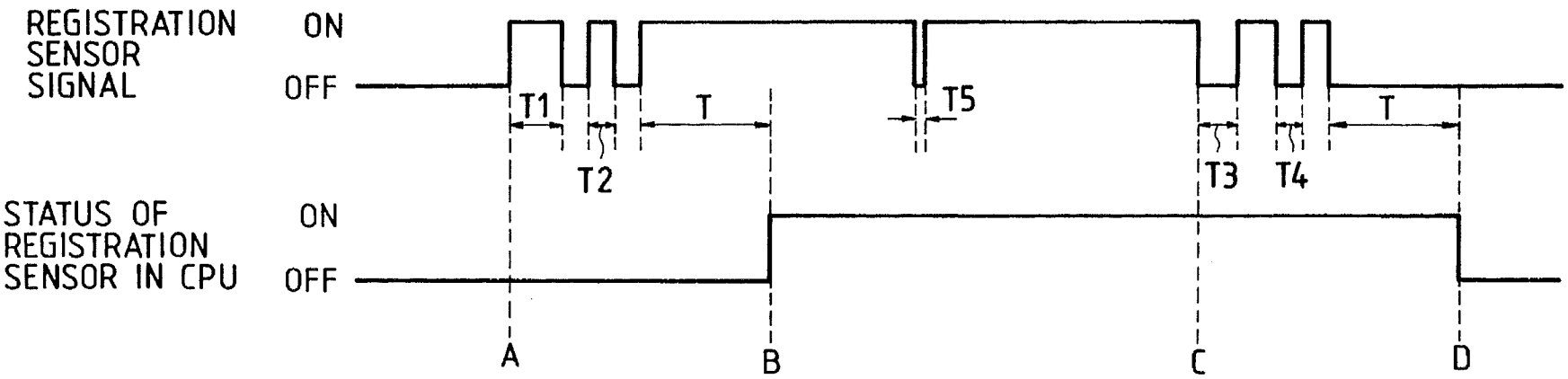
FIG. 19 is a time chart for explaining a debouncing method and a debouncing time.

A debouncing time and a debouncing method will be explained below with reference to FIG. 19. FIG. 19 is a timing chart showing a signal output from the registration sensor 10, and status information of the registration sensor 10 held in the CPU 1.

Until a timing A, the registration sensor signal and the status information of the registration sensor in the CPU 1 are OFF. Thereafter, when a cut paper sheet is conveyed, and reaches the registration roller position, the registration sensor signal is turned on and off when the conveyed cut paper sheet pushes up the registration sensor lever 601. Periods T1 and T2 in FIG. 19 are caused by this chattering. However, since each of these periods T1 and T2 is shorter than a predetermined time T, these periods are ignored, and the status information of the registration sensor in the CPU 1 is left unchanged from the previous state (i.e., OFF state).

At a timing B since the ON time of the registration sensor exceeds the predetermined time T, the status information of the registration sensor in the CPU 1 is set in an ON state. The internal process of the CPU 1 is executed based on the status information of the registration sensor in the CPU 1.

At a timing C, the conveyed cut paper sheet exits the registration rollers.

When the cut paper sheet exits the registration sensors, the trailing end of the cut paper sheet flips up the registration sensor lever, the registration sensor causes chattering, and the registration sensor signal is turned on and off. In FIG. 19, periods T3 and T4 are caused by this chattering. However, since each of the periods T3 and T4 is shorter than the predetermined time T, these periods are ignored, and the status information of the registration sensor in the CPU 1 is left unchanged from the previous state (i.e., ON state).

At a timing D, since the OFF time of the registration sensor exceeds the predetermined time T, the status information of the registration sensor in the CPU 1 is set in an OFF state.

As indicated by T5, the registration sensor signal is instantaneously changed from an ON state to an OFF state due to, e.g., noise. In this case as well, since the time T5 is shorter than the predetermined time T, the status information of the registration sensor in the CPU 1 maintains the same state as the previous state.

The above-mentioned method is called "debouncing", and the predetermined time T will be referred to as a debouncing time hereinafter.

Figure 10:
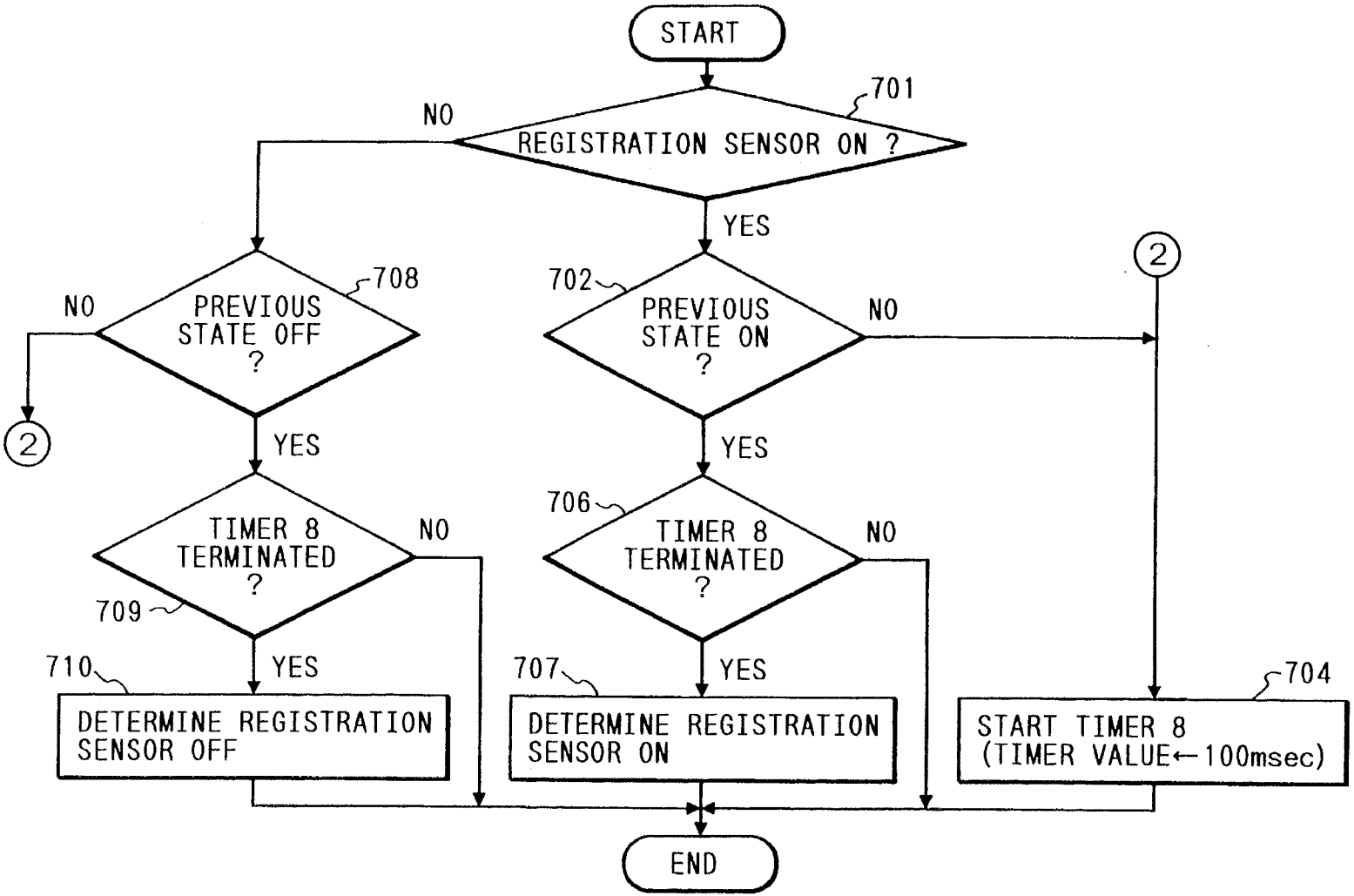
FIG. 10 is a flow chart for explaining an operation of the fourth embodiment.

FIG. 10 is a flow chart showing the operation of this embodiment.

The flow chart shown in FIG. 10 is a subroutine for performing paper presence/absence detection of the registration sensor 10.

In step 701, the ON (paper presence; High level)/OFF (paper absence; Low level) state of the registration sensor 10 is checked. If the registration sensor 10 is ON, it is checked in step 702 if the previous state is ON. If the previous state is OFF, a time (e.g., 100 msec) longer than a normal debouncing time (normally determined by two calling periods of this subroutine) is set as the timer value of a timer #8, and the timer #8 is started in step 704.

If it is determined in step 702 that the previous state is also ON, the CPU 1 monitors termination of the timer #8 in step S706. If the timer #8 is in operation, this subroutine ends; if the timer #8 is terminated, it is determined in step 707 that the registration sensor is ON. In order to turn on/off the registration rollers in FIG. 5, this information is used.

If it is determined in step 701 that the registration sensor is OFF, it is checked in step 708 if the previous state is OFF. If the previous state is ON, the flow advances to step 704; otherwise, the CPU monitors termination of the timer #8 in step 709. If the timer #8 is in operation, this subroutine ends; if the timer #8 is terminated, it is determined in step 710 that the registration sensor is OFF.

(Fifth Embodiment)

In the fourth embodiment, the debouncing time to be set when the status of the registration sensor 10 changes is set to be longer than the normal debouncing time within a predetermined period of time after the registration rollers 103 are driven. However, in this embodiment, a method of achieving debouncing by setting the debouncing time to be several tens of msec when the status of the registration sensor 10 changes from OFF to ON, and setting the debouncing time to be several hundreds of msec when the status of the registration sensor 10 changes from ON to OFF will be described below.

Figure 11:
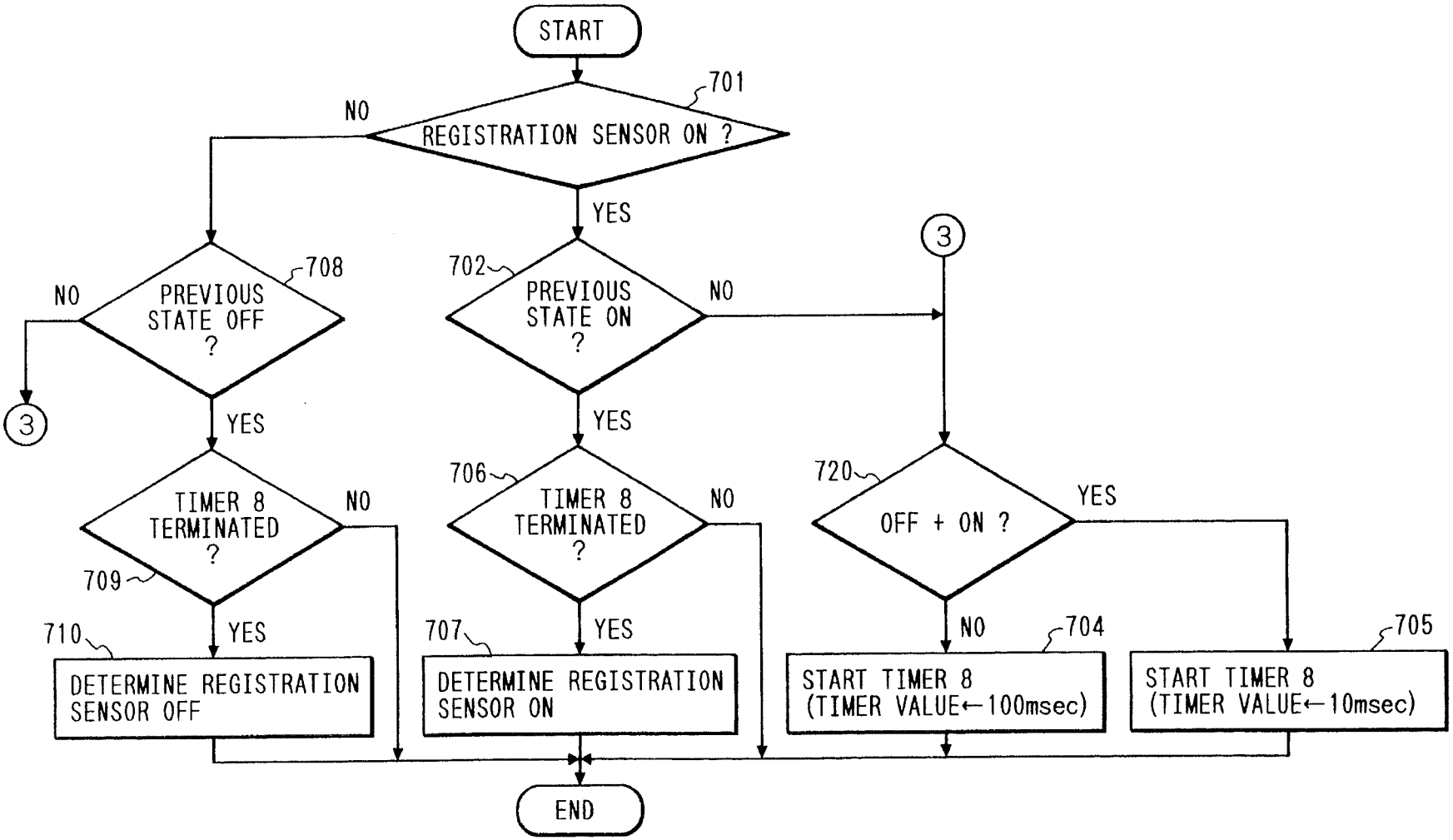
FIG. 11 is a flow chart for explaining an operation of the fifth embodiment.

FIG. 11 is a flow chart for explaining the operation of the fifth embodiment.

Since steps 701, 702, and 704 to 710 are the same as those in the fourth embodiment, a detailed description thereof will be omitted.

Before step 704, step 720 is used. If the status of the registration sensor changes from ON to OFF, the flow advances to step 704; if the status changes from OFF to ON, the flow advances to step 705. In step 705, 10 msec are set in the timer value.

(Sixth Embodiment)

In the fourth and fifth embodiments, the debouncing time of the registration sensor 10 is changed. In this embodiment, the same process is performed for the discharged paper sensor 11 arranged in the paper discharging section.

Since the operation is the same as those in the fourth and fifth embodiments, a detailed description thereof will be omitted.

As described above, according to the fourth to sixth embodiments, since the debouncing time is switched between a case wherein the sensor output changes and a case wherein the sensor output does not change, or is switched between a case wherein the sensor output changes from a paper absence state to a paper presence state and a case wherein the sensor output changes from a paper presence state to a paper absence state, a proper debouncing time can be set independently of different sensor functions, sensor applications, and the arrangement of the image recording apparatus, thus precisely achieving chattering prevention and jam detection during a paper convey operation.

(Seventh Embodiment)

The operation of the seventh embodiment will be described below with reference to the flow charts of FIGS. 12 and 13.

Figure 12:
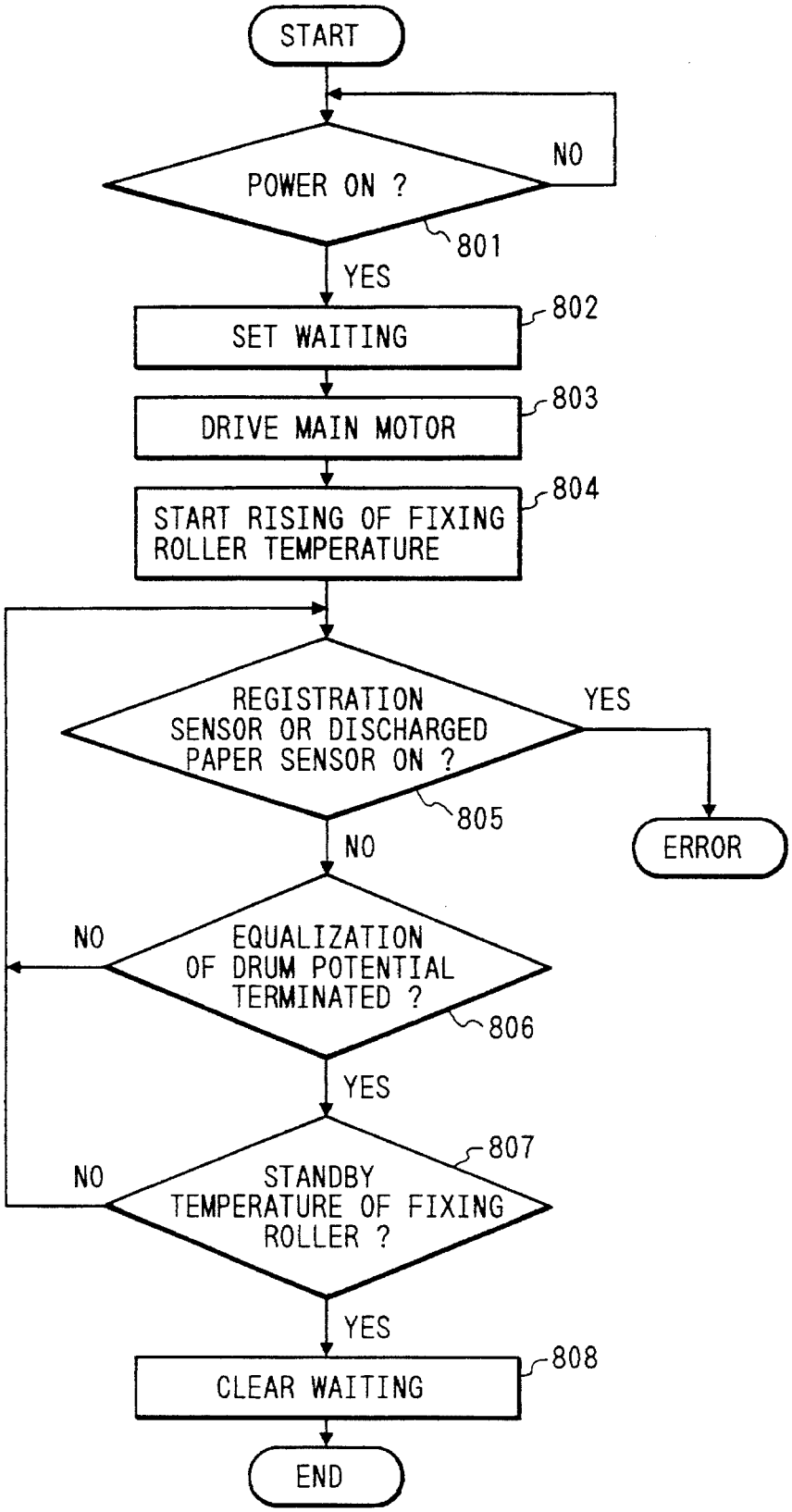
FIG. 12 is a flow chart for explaining an operation associated with the seventh and eighth embodiments.

FIG. 12 is a flow chart showing operations from a waiting state to a standby state of the image-recording apparatus. When the power supply is turned on in step 801, the image recording apparatus enters the waiting state, and a waiting bit is set in step 802.

In step 803, in order to equalize the potential of the photosensitive drum 104, the drive operation of the main motor 4 is started to rotate the photosensitive drum 104 and the transfer roller 105 for a predetermined period of time. In step 804, the surface temperature of the fixing roller 106 is raised to a standby temperature.

In step 805, it is checked if the registration sensor 10 or the discharged paper sensor 11 is ON. The ON state of the registration sensor 10 or the discharged paper sensor 11 in this step is a state determined by paper presence/absence detection by the sensor 10 or 11 (to be described later). If it is determined that the registration sensor 10 or the discharged paper sensor 11 is ON, a jam is determined, and this subroutine ends as an error.

If it is determined in step 806 that equalization of the drum potential is terminated, and it is determined in step 807 that the surface temperature of the fixing roller has reached the standby temperature, the waiting bit is cleared in step 808, and the apparatus enters the standby state. Since the subsequent processes are the same as those described above with reference to FIG. 5, a detailed description thereof will be omitted.

Figure 13:
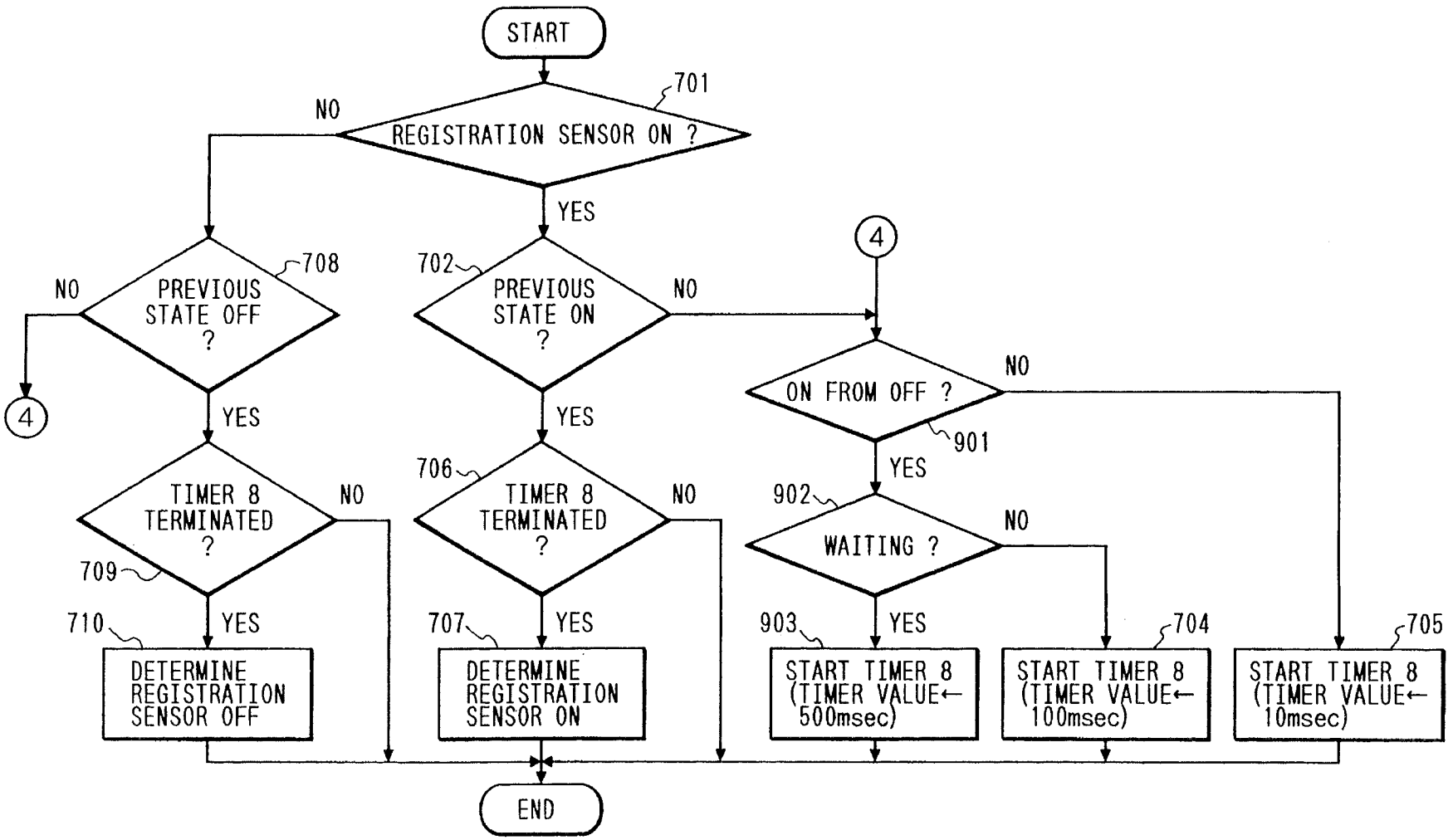
FIG. 13 is a flow chart for explaining an operation of the seventh embodiment.

FIG. 13 is a flow chart of a subroutine for performing paper presence/absence detection by the registration sensor 10.

In step 701, the ON (paper presence; High level)/OFF (paper absence; Low level) state of the registration sensor 10 is checked. If the registration sensor 10 is ON, it is checked in step 702 if the previous state is ON. If the previous state is OFF, the flow advances to step 901. If it is determined in step 901 that the status of the registration sensor 10 changes from OFF to ON, it is checked in step 902 if the state of the image recording apparatus is the waiting state or another state. If the image recording apparatus is in the waiting state, 500 msec, for example, are set in the timer #8, and the timer #8 is started in step 903. If the image recording apparatus is in a state other than the waiting state, for example, 100 msec shorter than the time in the waiting state are set in the timer #8, and the timer #8 is started in step 704.

If it is determined in step 901 that the status of the registration sensor 10 changes from ON to OFF, 10 msec, for example, are set in the timer #8, and the timer #8 is started in step 705.

If it is determined in step 702 that the previous state is also ON, the CPU monitors termination of the timer #8 in step 706. If the timer #8 is in operation, this subroutine ends; otherwise, it is determined in step 707 that the registration sensor 10 is ON.

If it is determined in step 701 that the registration sensor 10 is OFF, it is checked in step 708 if the previous state is OFF. If the previous state is ON, the flow advances to step 901; otherwise, the CPU monitors termination of the timer #8 in step 709. If the timer #8 is in operation, this subroutine ends; otherwise, it is determined in step 710 that the registration sensor 10 is OFF.

The ON/OFF state of the registration sensor 10 in the above-mentioned flow chart is determined in this manner.

As for the discharged paper sensor 11, a timer #9 is used in place of the timer #8. Since the paper presence/absence detection operation of the discharged paper sensor 11 is the same as that of the registration sensor 10, a detailed description thereof will be omitted.

(Eighth Embodiment)

In the seventh embodiment, the same debouncing time is set for the registration sensor 10 and the discharged paper sensor 11. In this embodiment, a method of switching the debouncing time between a sensor requiring a high response speed like the registration sensor 10, and a sensor requiring no high response speed like the discharged paper sensor 11 will be described below.

The paper presence/absence detection of the registration sensor 10 can be the same as that described above with reference to FIG. 13.

Figure 14:
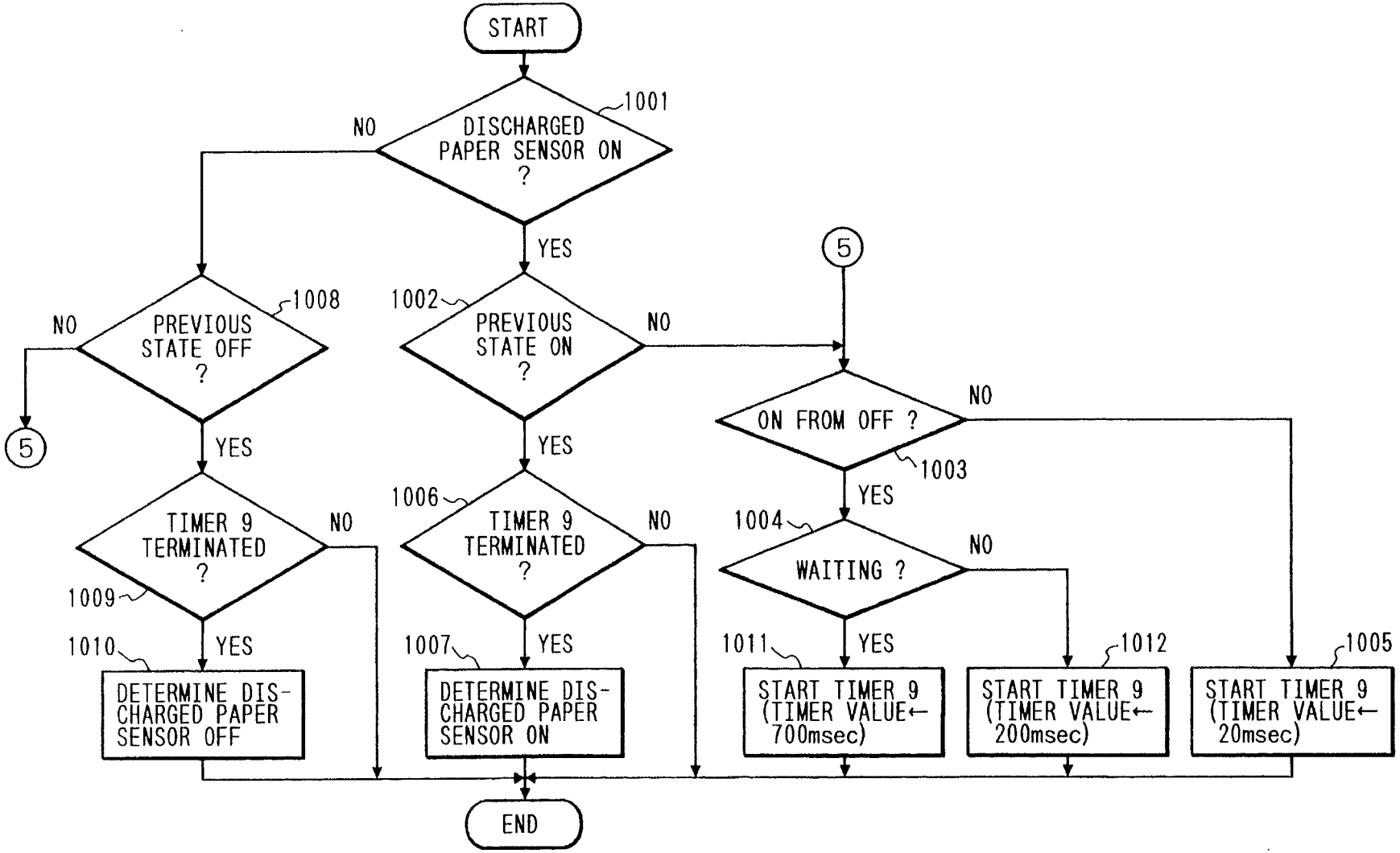
FIG. 14 is a flow chart for explaining an operation of the eighth embodiment.

The paper presence/absence detection method of the discharged paper sensor 11 will be described below with reference to the flow chart of FIG. 14.

In step 1001, the ON (paper presence; High level)/OFF (paper absence; Low level) state of the discharged paper sensor 11 is checked. If the discharged paper sensor 11 is ON, it is checked in step 1002 if the previous state is ON. If the previous state is OFF, the flow advances to step 1003. If it is determined in step 1003 that the status of the discharged paper sensor 11 changes from OFF to ON, it is checked in step 1004 if the state of the image recording apparatus is the waiting state or another state. If the image recording apparatus is in the waiting state, for example, 700 msec longer than the value used for the registration sensor 10 are set in the timer #9, and the timer #9 is started in step 1011. If the image recording apparatus is in a state other than the waiting state, for example, for example, 200 msec longer than the value used for the registration sensor 10 are set in the timer #9, and the timer #9 is started in step 1012.

If it is determined in step 1003 that the status of the discharged paper sensor 11 changes from ON to OFF, for example, 20 msec longer than the value used for the registration sensor 10 are set in the timer #9, and the timer #9 is started in step 1005.

If it is determined in step 1002 that the previous state is also ON, the CPU monitors termination of the timer #9 in step 1006. If the timer #9 is in operation, this subroutine ends; if the timer #9 is terminated, it is determined in step 1007 that the discharged paper sensor 11 is ON.

If it is determined in step 1001 that the discharged paper sensor 11 is OFF, it is checked in step 1008 if the previous state is OFF. If the previous state is ON, the flow advances to step 1003; otherwise, the CPU monitors termination of the timer #9 in step 1009. If the timer #9 is in operation, this subroutine ends; otherwise, it is determined in step 1010 that the discharged paper sensor 11 is OFF.

The ON/OFF state detection of the discharged paper sensor in the flow charts so far can use information determined as described above.

(Ninth Embodiment)

An operation of an image recording apparatus associated with the ninth embodiment will be briefly described below with reference to FIGS. 1 and 2.

When the power supply switch 32 is turned on, the respective ports of the CPU 1 are initialized and an internal RAM of the CPU 1 is cleared by a power-0N reset function of the CPU 1. Thereafter, the CPU 1 sends the motor ON signal 12 to the main motor control unit 3. Upon reception of this signal, the main motor control unit 3 drives the main motor 4. When the main motor 4 reaches a predetermined rotational speed, the main motor control unit 3 sends back the motor ready signal 13 to the CPU 1.

Thereafter, the CPU 1 sends the scanner ON signal 14 to the scanner motor control unit 5, and the scanner motor control unit 5 drives the scanner motor 6. When the scanner motor 6 reaches a predetermined rotational speed, the scanner motor control unit 5 sends back the scanner ready signal 15 to the CPU 1. Upon reception of the scanner ready signal 15, the CPU 1 turns off the scanner ON signal 14 to stop the drive operation of the scanner motor 6.

The CPU 1 sends a high voltage ON signal 28 to the high voltage control unit 27 to execute equalization of the potential of the photosensitive drum 104 and cleaning of the transfer roller 105 simultaneously with the drive operation of the scanner motor 6.

After an elapse of a predetermined period of time, the CPU turns off the high voltage ON signal 28 to stop high voltage control, and turns off the motor ON signal 12 to stop the drive operation of the main motor 4.

Upon completion of the above-mentioned process, the image recording apparatus enters a standby state. When the image recording apparatus in the standby state receives the PRNT signal 19 from the external apparatus 2, the CPU 1 drives the main motor 4 and the scanner motor 6. The CPU 1 drives the feed paper roller 7 to feed a cut paper sheet 110 in the cassette 111 to the position of the registration rollers 103.

Thereafter, the CPU 1 sends the VSREQ signal 20 to the external apparatus 2, and waits for the VSYNC signal 21 from the external apparatus 2. Upon reception of the VSYNC signal 21, the CPU 1 drives the registration rollers 103.

The VDO signal 22 from the external apparatus 2 is supplied to the laser unit 108 to modulate a laser beam. The laser beam emitted from the laser unit 108 is deflected and radiated onto the photosensitive drum 104 by the scanner motor 6 and the reflection mirror 109. Then, an image is transferred on the cut paper sheet 110 conveyed by the registration rollers 103 by the photosensitive drum 104 and the transfer roller 105.

Thereafter, the image transferred on the cut paper sheet 110 is fixed by the fixing roller 106 and the compression roller 107, and the cut paper sheet 110 is discharged onto the discharged paper tray 112 by the paper discharging rollers 114.

The registration sensor 10 and the discharged paper sensor 11 monitor the convey condition of each cut paper sheet 110. When a cut paper sheet 110 is present at the corresponding sensor position, the sensor is turned on; otherwise, the sensor is turned on. This information is read by the CPU 1.

It is checked whether or not the cut paper sheet 110 reaches the position of the registration sensor 10 within a predetermined period of time after the feed paper roller 7 is driven, whether or not the cut paper sheet 110 is removed from the position of the registration sensor 10 within a predetermined period of time after the registration rollers 103 are driven, whether or not the cut paper sheet 110 reaches the position of the discharged paper sensor 11 within a predetermined period of time, and whether or not the cut paper sheet 110 is removed from the position of the discharge paper sensor 11 within a predetermined period of time after the cut paper sheet 110 reaches the position of the discharged paper sensor 11. Thus, it is determined if the cut paper sheet is normally conveyed or has jammed.

In the main motor drive operation executed immediately after the power supply switch 32 is turned on and the power-ON reset mode is started or before the control enters the standby state, whether or not a residual paper sheet is present in the image recording apparatus is checked based on the outputs from the registration sensor 10 and the discharged paper sensor 11.

When a residual paper sheet is present in the image recording apparatus, if the surface temperature of the fixing roller 106 exceeds a paper discharging possible temperature, the paper sheet remaining in the image recording apparatus is discharged. Otherwise, a paper jam is determined.

Figure 15:
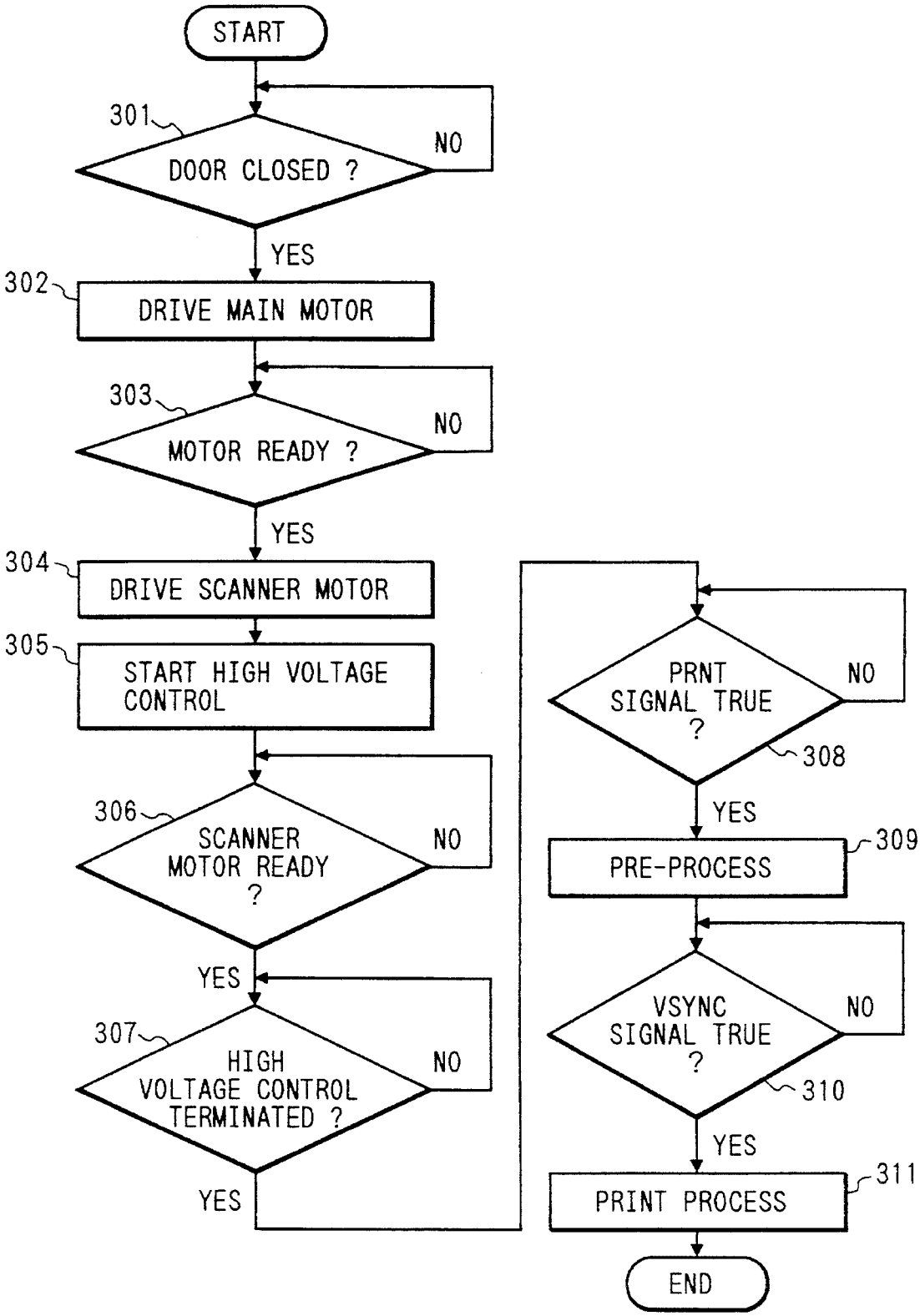
FIG. 15 is a flow chart for briefly explaining an operation associated with the ninth to eleventh embodiments.
Figure 16:
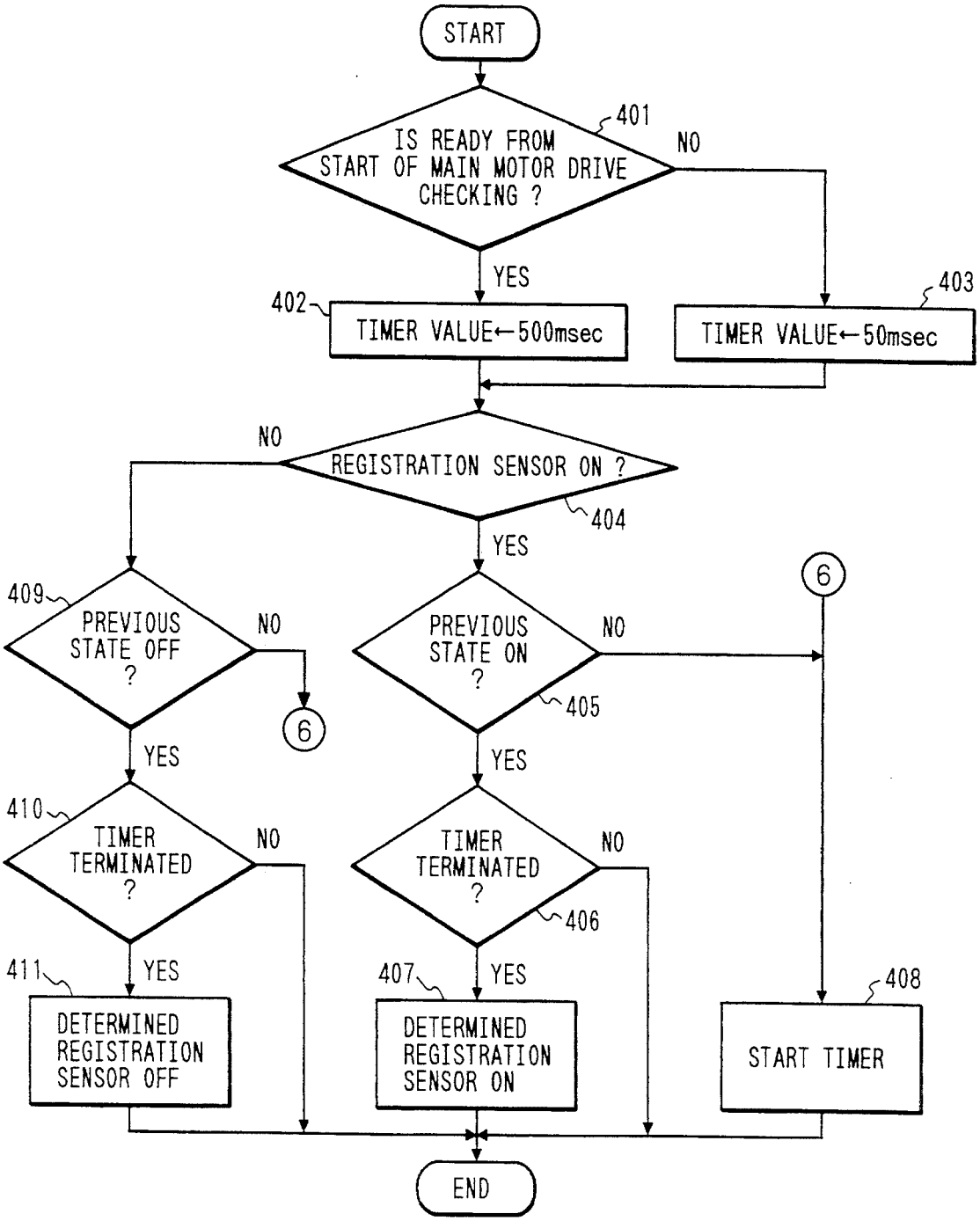
FIG. 16 is a flow chart for explaining an operation of the ninth embodiment.

FIGS. 15 and 16 are flow charts showing characteristic operations of this embodiment.

FIG. 15 shows a main routine of image recording apparatus control executed by the CPU 1, and FIG. 16 shows a subroutine called from the main routine. In this subroutine paper presence/absence detection of the registration sensor 10 and the discharged paper sensor 11 is performed.

When the power supply switch 32 is turned on, the main routine is started. In step 301, it is checked if the door switch 31 is ON (door closed) or OFF (door open). If the door switch indicates the door closed state, the drive operation of the main motor 4 is started in step 302.

In step 303, the CPU monitors if the motor is ready. If the motor is ready, the drive operation of the scanner motor 6 is started in step 304, and high voltage control is started in step 305.

In step 306, the CPU monitors if the scanner motor is ready. If the scanner motor is ready, the CPU waits for termination of the high voltage control in step 307.

In step 308, the CPU waits for the PRNT signal from the external apparatus 2. Upon reception of the PRNT signal, the CPU executes a pre-process for the print operation in step 309. The pre-process includes the drive operations of the main motor 4 and the scanner motor 6, the feed paper operation of a cut paper sheet 110, and an output operation of the VSREQ signal 20 to the external apparatus 2, as described above.

In step 310, the CPU waits for the VSYNC signal 21 sent from the external apparatus. In step 311, the CPU executes a print process as processes from the drive operation of the registration rollers 103 up to the paper discharging operation described above.

FIG. 16 shows a subroutine for executing paper presence/absence detection of the registration sensor 10. Since the subroutine for paper presence/absence detection of the discharged paper sensor 11 is the same as that shown in FIG. 16, a detailed description thereof will be omitted.

If it is determined in step 401 that the CPU is executing steps between the start of the main motor drive operation (step 302) and detection of a motor ready state (YES in step 303), a time (e.g., 500 msec) sufficiently longer than the other case is set in the timer value in step 402. Otherwise, 50 msec are set in the timer value in step 403.

In step 404, the ON/OFF state of the registration sensor 10 is checked. If the registration sensor 10 is ON, it is checked in step 405 if the previous state is ON. If the previous state is OFF, the above-mentioned timer value is set, and the timer is started in step 408.

If it is determined in step 405 that the previous state is also ON, the CPU monitors termination of the timer in step 406. If the timer is in operation, this subroutine ends; otherwise, it is determined in step 407 that the registration sensor is ON.

If it is determined in step 404 that the registration sensor is OFF, it is checked in step 409 if the previous state is OFF. If the previous state is ON, the flow advances to step 408; otherwise, the CPU monitors termination of the timer in step 410. If the timer is in operation, the subroutine ends; otherwise, it is determined in step 411 that the registration sensor is OFF.

(Tenth Embodiment)

In the ninth embodiment, the debouncing time of the registration sensor is changed between a time period from the start of the main motor drive operation until detection of a motor ready state, and other cases.

Figure 17:
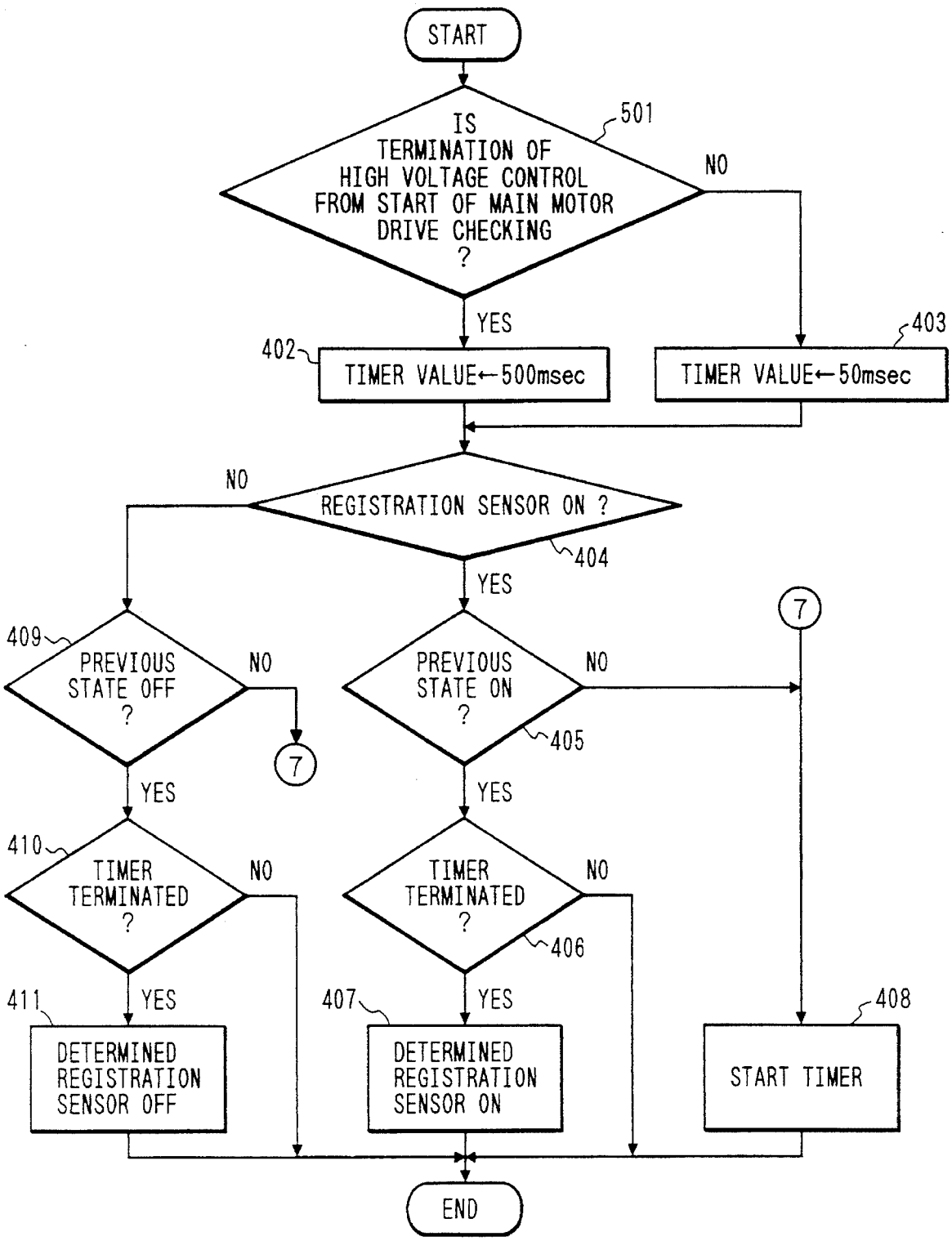
FIG. 17 is a flow chart for explaining an operation of the tenth embodiment.

FIG. 17 shows the tenth embodiment.

In step 501, it is checked if the CPU is executing steps from the start of the main motor drive operation (step 302) to termination of high voltage control (YES in step 307), and the debouncing time of the registration sensor is changed according to the checking result.

Since subsequent steps 402 to 411 are the same as those in the ninth embodiment, a detailed description of the operation will be omitted.

(Eleventh Embodiment)

In the ninth and tenth embodiments, the debouncing time of the registration sensor 10 is changed in accordance with the state of the image recording apparatus.

Figure 18:
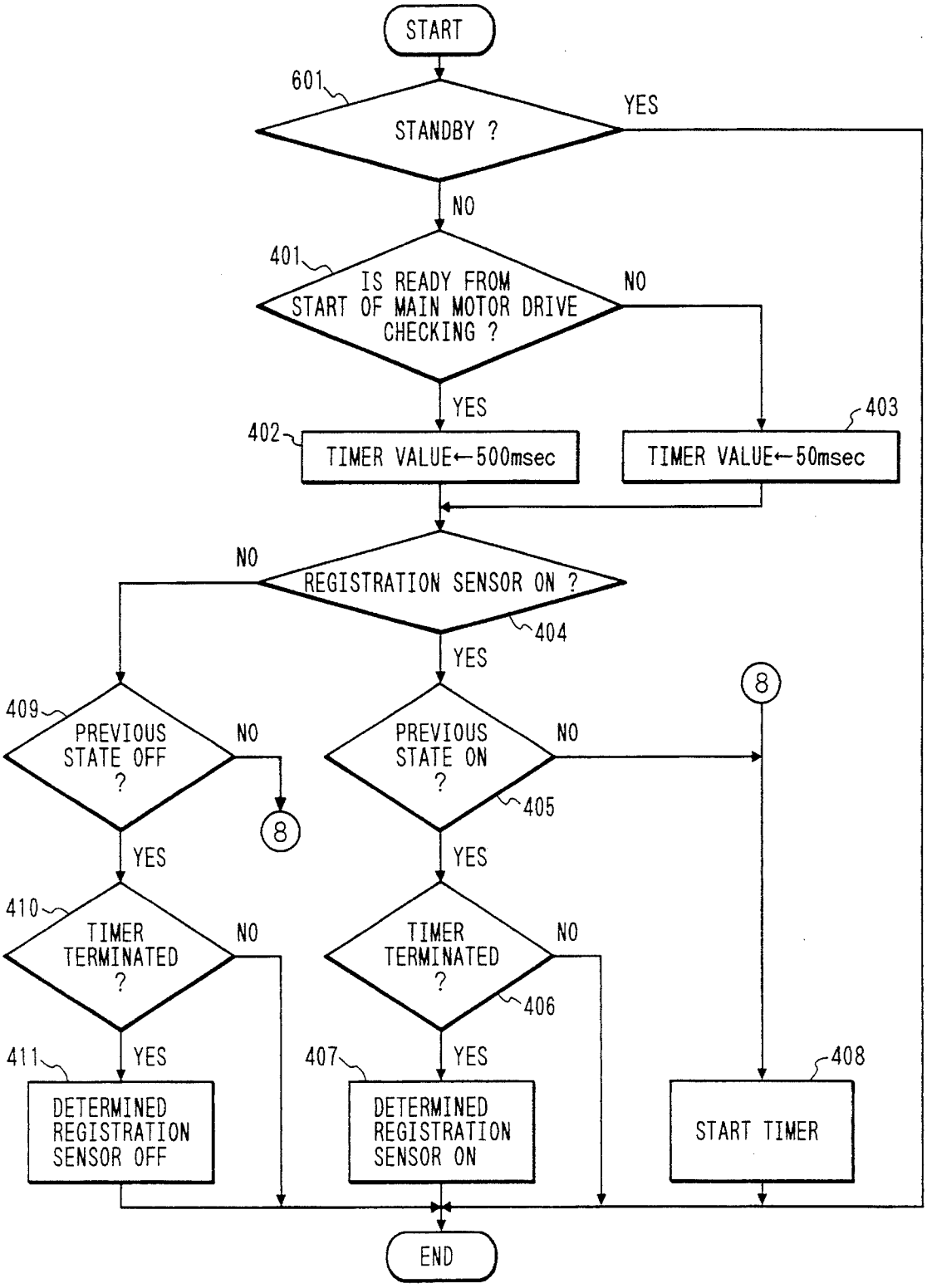
FIG. 18 is a flow chart for explaining an operation of the eleventh embodiment.

FIG. 18 shows the eleventh embodiment.

In step 601, it is checked if the apparatus is in the standby state (the CPU waits for the PRNT signal in step 308). If the apparatus is in the standby state, this subroutine ends. Otherwise, since the same operation as in the ninth embodiment is performed, a detailed description of thereof will be omitted.

As described above, the debouncing time is switched in correspondence with the sensor output or the sensor output is ignored according to the state of the image recording apparatus. Thus, erroneous detection caused by chattering of the sensor due to vibration upon driving of the main motor or erroneous detection caused by noise generated when the high voltage control is started can be prevented.

What is claimed is:

1. An image recording apparatus for printing an image on a conveyed recording medium, comprising:

detecting means, arranged on a convey path of the recording medium, for detecting presence/absence of the recording medium;

setting means for setting a debouncing time for said detecting means;

registration rollers; and control means for stopping a drive operation of said registration rollers in response to a change in paper presence/absence detection state of said detecting means from the paper presence state to the paper absence state, wherein said detecting means is arranged upstream of said registration rollers in a paper convey direction.

2. An apparatus according to claim 1, further comprising switching means for switching the debouncing time between a case wherein a presence/absence state of the recording medium detected by said detecting means changes from a paper presence state to a paper absence state and a case wherein the presence/absence state changes from the paper absence state to the paper presence state.

3. An apparatus according to claim 1, wherein said control means comprises time measuring means for measuring a drive time of said registration rollers, and said registration rollers are driven independently of the detection state of said detecting means while said time measuring means is measuring a predetermined period of time after the drive operation of said registration rollers is started.

4. An apparatus according to claim 1, further comprising time measuring means for measuring a drive time of said registration rollers, wherein said detecting means does not detect the presence/absence of the recording medium until a predetermined period of time, as measured by said time measuring means, after the drive operation of said registration rollers is started.

5. An apparatus according to claim 1, further comprising:

state detecting means for detecting a state of said image recording apparatus, and switching means for switching the debouncing time in accordance with the state of said image recording apparatus detected by said state detecting means.

6. An apparatus according to claim 1, further comprising:

image forming means for electrostatically forming an image onto the recording medium.

7. An apparatus according to claim 6, wherein said image forming means comprises means for transferring an image formed on an image carrier onto the recording medium, and said switching means switches the debouncing time for a predetermined period of time after a drive operation of said image carrier is started.

8. An apparatus according to claim 1, further comprising:

registration rollers, and switching means for switching the debouncing time for a predetermined period of time in response to start of a drive operation of said registration rollers.

9. An apparatus according to claim 1, wherein said detecting means is arranged near a discharging section of the recording medium.

10. An apparatus according to claim 1, wherein said apparatus starts an image forming operation in response to a print command from an external apparatus, and further comprising switching means for switching the debouncing time when said apparatus waits for reception of the print command.

11. An image recording apparatus for printing an image on a conveyed recording medium, comprising:

a plurality of detecting means, arranged at different positions on a convey path of the recording medium, for detecting a presence/absence of the recording medium; and setting means capable of setting different debouncing times for each detecting means of said plurality of detecting means.

12. An apparatus according to claim 11, further comprising:

image forming means for forming an image onto the recording medium, and wherein said image forming means electrostatically forms an image.

13. An apparatus according to claim 11, wherein one of said plurality of detecting means is arranged near a discharging section of the recording medium.

14. An apparatus according to claim 11, further comprising:

registration rollers, wherein one of said plurality of detecting means is arranged near the registration rollers.

15. An apparatus according to claim 14, further comprising registration rollers, and control means for stopping a drive operation of said registration rollers in response to a change in paper presence/absence detection state of said one of said plurality of detecting means from the paper presence state to the paper absence state, wherein said one of said plurality of detecting means is arranged at an upstream side of said registration rollers in a paper convey direction.

16. An apparatus according to claim 15, further comprising:

time measuring means for measuring a drive time of said registration rollers, and wherein said one of said plurality of detecting means does not detect the presence/absence of the recording medium while said time measuring means is measuring a predetermined period of time after the drive operation of said registration rollers is started.

* * * * *

UNITED STATES PATENT AND TRADEMARK OFFICE

CERTIFICATE OF CORRECTION

PATENT NO. : 5,455,659
DATED : October 3, 1995
INVENTOR(S) : MASANORI ISHIZU, ET AL.

It is certified that error appears in the above-indentified patent and that said Letters Patent is hereby corrected as shown below: On title page, item [56] RC,
line USPD, insert --4,853,740 8/1989 Ushio et al. ... 355/319, 4,927,131 5/1990 Hashimoto et al. ... 271/215--.

Column 3,
line 15, "0N" should read --ON--;
line 17, "0N" should read --ON--;
line 38, "0N" should read --ON--; and
line 56, "signal" should read --signal 17--.

Column 4,
line 55, "S512," should read --512,--.

Column 8,
line 11, "S706." should read --706.--; and
line 18, "CPU" should read --CPU 1--.

Column 10,
line 57, "power-0N" should read --power-ON--.

Column 13,
line 20, "of" should be deleted.

Column 14,
line 6, "and switching" should read --and (begin new paragraph) switching--.

Signed and Sealed this

Twenty-seventh Day of February, 1996

Attest:

Bruce Lehman

BRUCE LEHMAN

Attesting Officer

Commissioner of Patents and Trademarks